US007071886B2

(12) United States Patent
Doi et al.

(10) Patent No.: US 7,071,886 B2
(45) Date of Patent: Jul. 4, 2006

(54) GLASS ANTENNA AND GLASS ANTENNA SYSTEM FOR VEHICLES

(75) Inventors: Ryokichi Doi, Minato-Ku (JP); Hiroshi Iijima, Minato-Ku (JP)

(73) Assignee: Nippon Sheet Glass Company, Limited, Tokyo (JP)

( * ) Notice: Subject to any disclaimer, the term of this patent is extended or adjusted under 35 U.S.C. 154(b) by 50 days.

(21) Appl. No.: 10/981,118

(22) Filed: Nov. 4, 2004

(65) Prior Publication Data

US 2005/0128153 A1 Jun. 16, 2005

(30) Foreign Application Priority Data

Nov. 4, 2003 (JP) ..... 2003-374016

(51) Int. Cl.
*H01Q 1/32* (2006.01)

(52) U.S. Cl. ..... 343/713; 343/767

(58) Field of Classification Search ..... 343/711, 343/712, 713, 714, 716, 717, 767; H01Q 1/32
See application file for complete search history.

(56) References Cited

U.S. PATENT DOCUMENTS

| | | | | |
|---|---|---|---|---|
| 5,177,494 | A * | 1/1993 | Dorrie et al. | 343/711 |
| 5,610,618 | A | 3/1997 | Adrian et al. | |
| 5,646,637 | A | 7/1997 | Miller | |
| 6,417,811 | B1 | 7/2002 | Adrian | |
| 6,498,588 | B1 | 12/2002 | Callaghan | |
| 6,937,198 | B1 * | 8/2005 | Iijima et al. | 343/713 |
| 2005/0035913 | A1 * | 2/2005 | Baranski | 343/713 |

FOREIGN PATENT DOCUMENTS

| | | |
|---|---|---|
| DE | 3714979 A1 | 11/1988 |
| DE | 101 06 125 A1 | 8/2002 |

* cited by examiner

*Primary Examiner*—Hoanganh Le
(74) *Attorney, Agent, or Firm*—RatnerPrestia

(57) ABSTRACT

A glass antenna for vehicles comprising a slot antenna constructed without using an electrical conductive transparent film is provided. A glass antenna for vehicles formed on a window glass for receiving a digital TV band comprises a rectangular slot antenna one side thereof is formed by an edge of a vehicle body surrounding the window glass and residual three sides are formed by a silver printed line formed on the window glass, both ends of the silver printed line being connected to the vehicle body by means of lead wires, respectively, and a feeder for supplying electric power to the slot antenna.

11 Claims, 6 Drawing Sheets

500MHz

602MHz

704MHz

GLASS ANTENNA AND GLASS ANTENNA SYSTEM FOR VEHICLES

BACKGROUND OF THE INVENTION

1. Field of the Invention

The present invention relates to a glass antenna for vehicles, particularly to a glass antenna for receiving a digital TV broadcast formed on a rear glass. The present invention further relates to a glass antenna system using such a glass antenna.

2. Description of the Related Art

As a digital TV antenna for a vehicle, an antenna consisting of a pattern provided by a silver paste material formed on a glass window has been proposed as disclosed in Japanese Patent Publication Nos. 2002-135025 and 2003-124719.

In Japanese Patent Publication No. 2002-135025, there is disclosed that dedicated antennas for a digital TV broadcast are formed near the upper portions of a front glass and rear glass of a vehicle together with a reflector element and director element to control the directivity of the antenna, respectively.

In Japanese Patent Publication No. 2003-124719, there is disclosed a digital TV antenna which also serves as an antenna for other existed broadcasts, e.g., an analog TV broadcast.

As a slot antenna for a vehicle, an antenna has been proposed in which an electrical conductive film is coated on a front or rear window of a vehicle to form a slot between a vehicle body and the electrical conductive film as disclosed in Japanese Patent Publication Nos. 03-204202, 06-45817, and 09-175166.

It is difficult that a digital TV antenna having a good sensitivity is realized on a rear glass of a vehicle by the conventional antenna using silver printed lines. This is because a digital TV antenna of this type interferes with a plurality of (at most seven) other antennas of the same type provided in proximity to the digital TV antenna, resulting a low sensitivity thereof.

An antenna for existed broadcasts, e.g., an analog TV broadcast, may not be used as a dedicated antenna for a digital TV broadcast, because each of the existed broadcasts has a wide frequency range, resulting in the decrease of a sensitivity thereof.

In a case that a slot antenna is used, an electrical conducting transparent film is required to form a slot antenna on a glass window of a vehicle, because the peripheral portion of a slot antenna should be an electrical conducting material and the transparency of the glass window should not be disturbed.

SUMMARY OF THE INVENTION

An object of the present invention is to provide a glass antenna for vehicles comprising a slot antenna constructed without using an electrical conducting transparent film.

Another object of the present invention is to provide a glass antenna for vehicles in which the interference with existed antennas is reduced.

A further object of the present invention is to provide a glass antenna system for vehicles in which a diversity reception is possible using the antenna in accordance with the present invention.

The present invention is directed to a glass antenna for vehicles formed on a window glass for receiving a digital TV band. The glass antenna comprises a rectangular slot antenna one side thereof is formed by an edge of a vehicle body surrounding the window glass and residual three sides thereof are formed by a printed line formed on the window glass, both ends of the printed line being connected to the vehicle body by means of lead wires, respectively; and a feeder for feeding electric power to the slot antenna.

The length of the slot antenna is preferably $\frac{1}{2}\times\kappa$–$\frac{9}{10}\times\kappa$ times the wave length of UHF band in view of an antenna sensitivity.

The width of the slot antenna is also preferably $\frac{1}{100}\times\kappa$–$\frac{1}{25}\times\kappa$ times the wave length of UHF band in view of an antenna sensitivity.

Herein, $\kappa$ is a shortening factor. The shortening factor relates to a propagation rate of a wave propagated through a dielectric substrate (a glass plate in this case), and is a ratio of the size of an antenna formed on the dielectric substrate to be resonated with respect to the size of an antenna provided in a space to be resonated. $\kappa$ is generally in a range of 0.55–1.00.

The width of the printed line which constructs the slot antenna is preferably in a range of 1 mm–5 mm in view of reducing a loss resistance to decrease a loss of electric power.

The distance between a feeding terminal of the feeder and one end of the slot antenna is preferably $\frac{1}{20}$–$\frac{1}{4}$ times the length of the slot antenna in view of an antenna sensitivity.

The present invention is further directed to a glass antenna system for vehicles. The glass antenna system comprises a slot antenna which is formed on an area between an upper edge of the vehicle body surrounding a rear glass and other at least one antenna on the rear glass on which heating lines are provided for defrosting; and a printed line for separation, formed between the slot antenna and the other at least one antenna, for reducing the interference between the slot antenna and the other at least one antenna.

According to the present invention, the following advantageous effects are obtained.

(1) As a slot antenna for a digital TV broadcast is formed in a narrow gap along an edge of a vehicle body, an antenna for a digital TV broadcast having a better sensitivity may be provided in addition to existed antennas for broadcasts.

(2) Both of the vehicle body and the printed line function as conductors to operate as a slot antenna by adjusting size thereof, so that a slot antenna may be formed without using an electrical conductive transparent film.

DETAILED DESCRIPTION OF PREFERRED EMBODIMENTS OF THE INVENTION

Figure 1A:
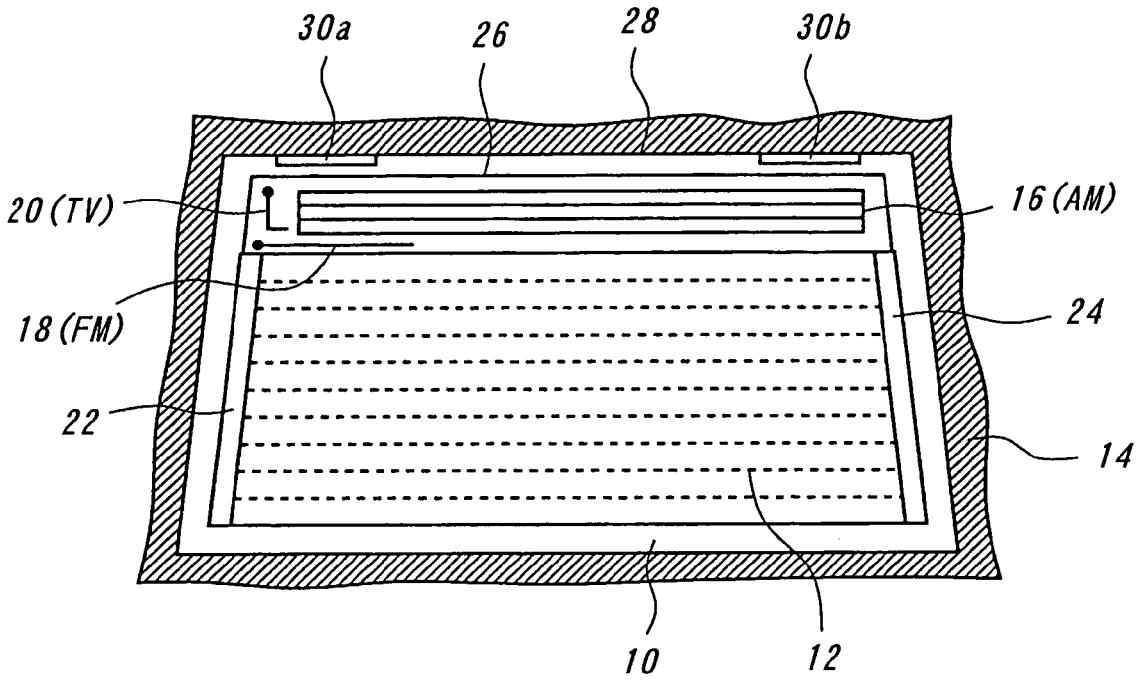
FIGS. 1A and 1B show an example of a glass antenna for vehicles in accordance with the present invention.

Referring to FIG. 1, there is shown an example of a glass antenna for vehicles in accordance with the present invention. As shown in FIG. 1A, an AM antenna 16, an FM antenna 18 and a TV antenna 20 for existed broadcasts are provided in a space on a rear glass 10 between an uppermost heating line 12 and an edge of vehicle body 14. A silver printed line for separation 26 connected to bus bars 22 and 24 for heating lines 12 is provided so as to enclose the existed antennas 16, 18 and 20. In a narrow space between the silver printed line 26 and the body edge 28, there are formed two slot antennas 30*a* and 30*b* by silver printed lines.

As the structures of the two slot antennas are the same, these slot antennas are respectively referred to as a slot antenna 30 when the two slot antennas are not required to be distinguished.

White two slot antennas are provided for a diversity reception in FIG. 1A, one slot antenna may be provided when a diversity reception is not used.

Figure 1B:
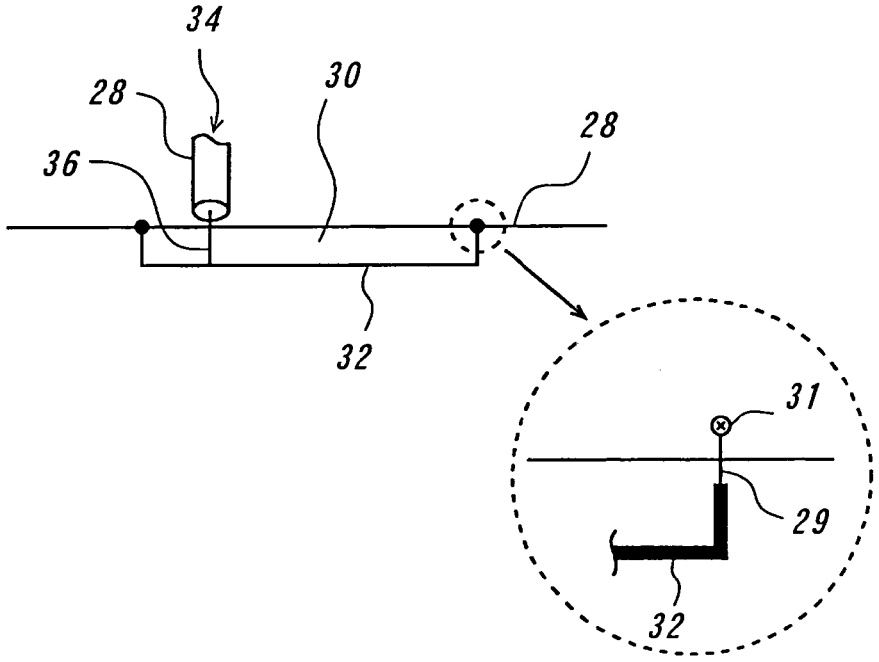

Referring to FIG. 1B, there is shown an enlarged view of the slot antenna 30. The shape of the slot antenna is rectangle in which one side is structured by the upper edge 28 of the vehicle body 14 and residual three sides are structured by the silver printed lines 32 formed on the rear glass. In this case, the slot antenna 30 is formed along the upper edge 28 of the vehicle body.

As the silver printed line 30 may not be connected directly to the body edge 28, both ends of the silver printed line 32 are connected to the body edge 28 by means of lead wires 29, respectively. One end of the lead wire is soldered to the silver print wire 32, and the other end thereof to the body edge by means of a screw or bolt 31.

Electric power is supplied to the slot antenna through a coaxial feeder 34, a central conductor 36 thereof being connected to the silver print wire 32 and an outer conductor thereof to the body 14. The portion where the coaxial feeder 34 is fixed (i.e., a feeding position) is selected in such a manner that the impedance of the coaxial feeder is matched to that of the slot antenna. This impedance matching is generally implemented based on an experimental data.

Figure 2:
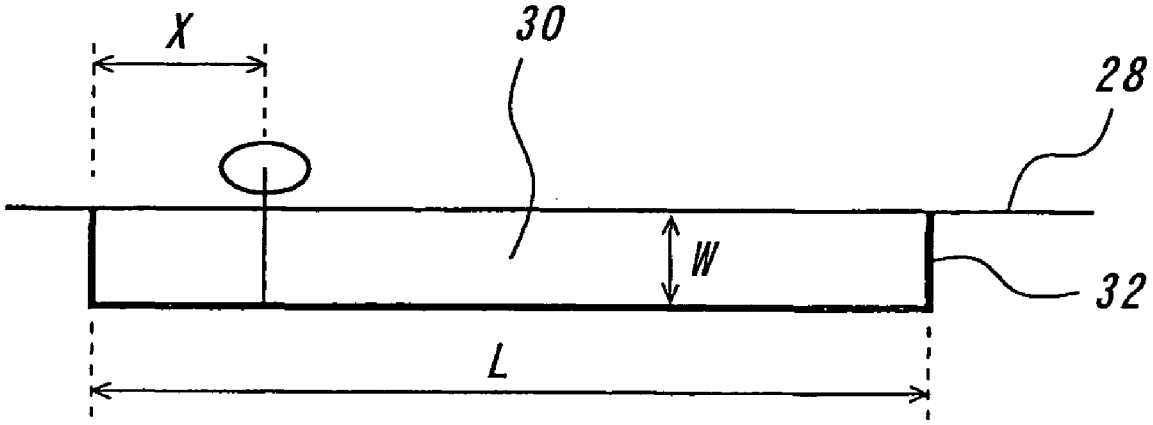
FIG. 2 shows a size of the rectangular slot antenna.

Referring to FIG. 2, there is shown a size of the rectangular slot antenna 30. A length of the slot antenna is L and a width thereof is W as shown in the figure. A feeding point is shown at the distance X from one end of the slot antenna 30 in the figure.

Next, the measured result for a sensitivity of one slot antenna will now be described, the one slot antenna having the determined length and width, and the determined line width of the silver printed line 32 structuring the slot antenna.

It is assumed that the width W of the slot antenna 30 is 10 mm, the line width of the silver printed line 32 is 1 mm, and the feeding point X is L/20. The length L of the slot antenna is varied such as 0.3 λ×κ, 0.4 λ×κ, 0.5 λ×κ, 0.6 λ×κ, 0.7 λ×κ, 0.8 λ×κ, 0.9 λ×κ, and 1.0 λ×κ (λ is a wave length of a radio wave).

Figure 3:
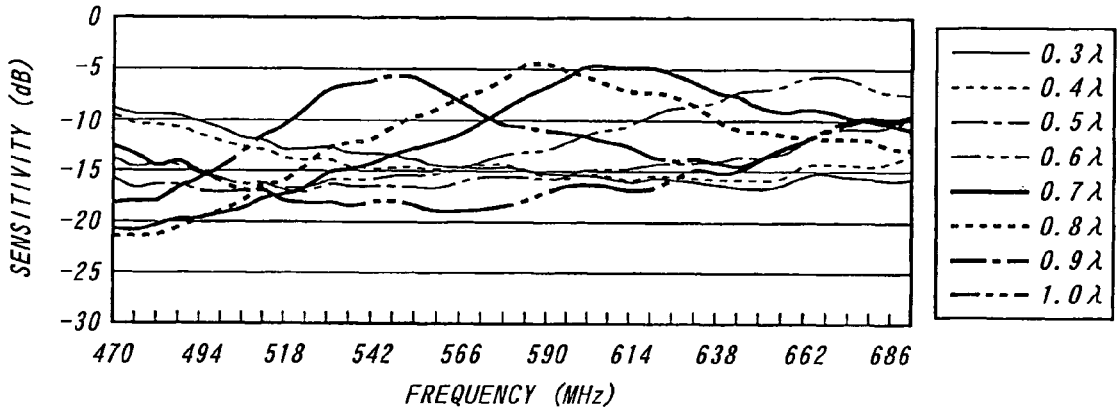
FIG. 3 shows the measured results of antenna sensitivities.

Respective sensitivities of such slot antennas each formed on a rear glass are measured in a radio unechoic chamber with the frequency of a radio wave varied in a range of 470–686 MHz. FIG. 3 shows the measured results.

It is appreciated from the measured results that a better sensitivity is obtained when L is in a range of 0.5 λ×κ–0.9 λ×κfor the feeding point X of L/20.

Table 1 shows an average sensitivity for a band width of 470–686 MHz.

TABLE 1

| L | Average sensitivity (dB) |
|---|---|
| 0.3λ × κ | −13.9 |
| 0.4λ × κ | −14.0 |
| 0.5λ × κ | −14.5 |
| 0.6λ × κ | −12.2 |
| 0.7λ × κ | −11.7 |
| 0.8λ × κ | −11.7 |
| 0.9λ × κ | −11.5 |
| 1.0λ × κ | −15.4 |

Next, the relation between the feeding point X and the antenna sensitivity are measured with the length L of the slot antenna being 0.92 λ×κand the line width of the silver printed line 32 being 1 mm. The feeing point X is varied such as L/20, L/10, L/4 and L/2.

Figure 4:
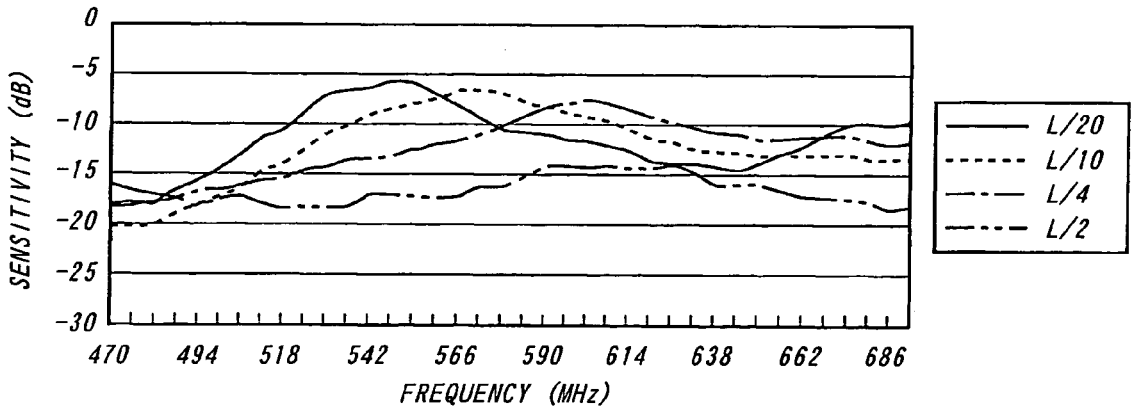
FIG. 4 shows the measured results of antenna sensitivities.

Respective sensitivities of such slot antennas each formed on a rear glass are measured in a radio unechoic chamber with the frequency of a radio wave being varied in a range of 470–686 MHz. FIG. 4 shows the measured result.

It is appreciated from the measured results that a better sensitivity may be obtained when the feeding point X is in a range of L/20–L/4 for the antenna length L of 0.9 λ×κ, Table 2 shows an average sensitivity for the band width of 470–686 MHz.

TABLE 2

| X | Average sensitivity (dB) |
|---|---|
| L/20 | −11.5 |
| L/10 | −12.2 |
| L/4 | −12.3 |
| L/2 | −16.4 |

Next, the measured result for a directivity of one slot antenna will now be described, the one slot antenna having the determined length and width, and the determined line width of the silver pointed line 32 structuring the slot antenna.

Figure 5A:
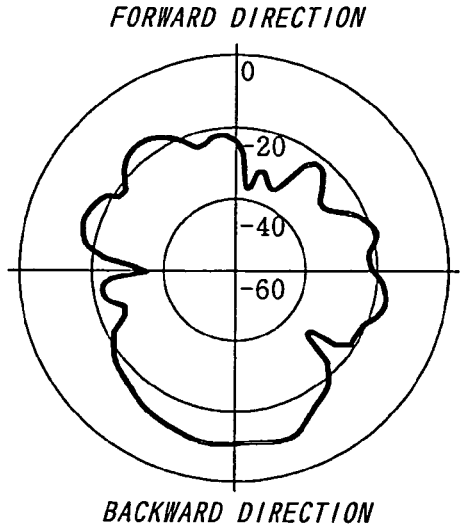
FIGS. 5A, 5B and 5C show the measured results of directivities.
Figure 5B:
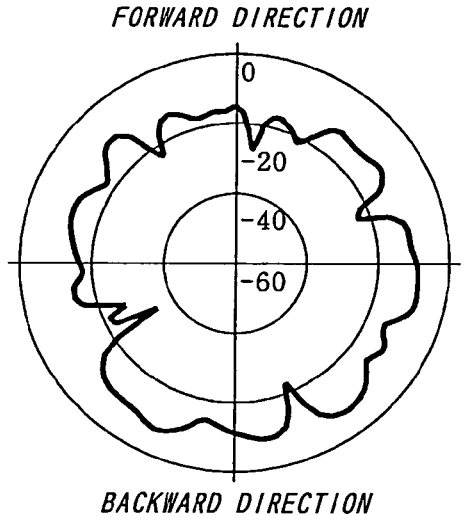
Figure 5C:
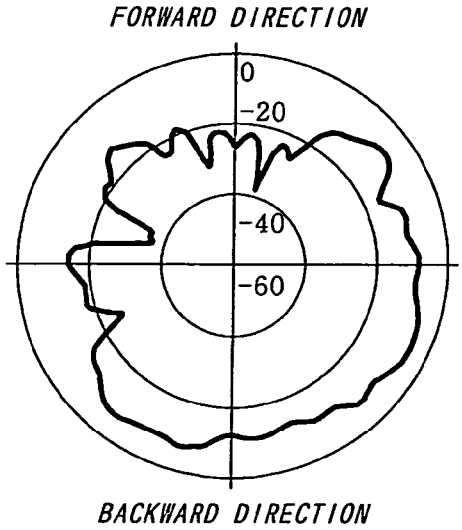

A slot antenna is formed on the rear glass of vehicles, the length L thereof being 0.9 λ×κ, the width W thereof being 10 mm, the line width of the silver printed line 32 being 1 mm, and the feeding point X being L/10. Respective directivities of the slot antenna are measured in a radio unechoic chamber with the frequency being varied in 500 MHz, 602 MHz, and 704 MHz. FIGS. 5A, 5B and 5C show the measured results, in which respective reflectivities for 500 MHz, 602 MHz and 704 MHz are illustrated. Each upper side of respective figures shows the forward direction of a vehicle and each lower side the backward direction of a vehicle. It is appreciated from these directivities that a better directivity may be obtained in the backward direction of a vehicle.

Figure 6:
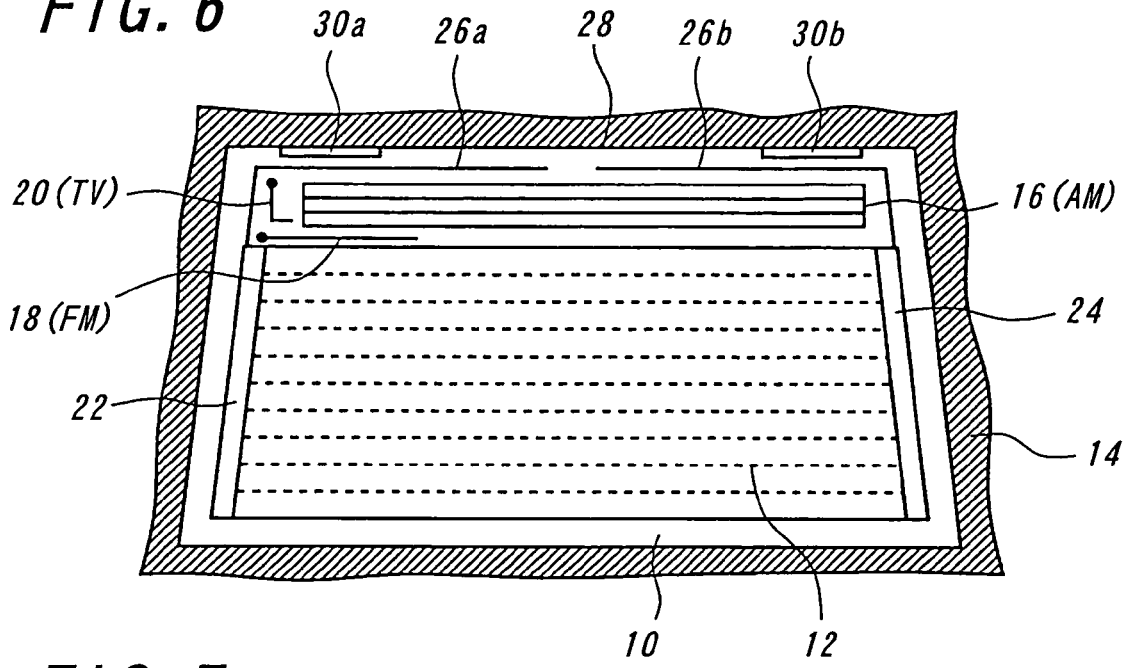
FIG. 6 shows another example of a glass antenna for vehicles in accordance with the present invention.

In the glass antenna described above, the printed line for separation is provided so as to be electrically conducted to the bus bars for heating lines to delete the frost on a rear glass. Therefore, when a direct current flows through the heating lines for defrosting, a direct current also flows through the printed line for separation. In order to avoid this, the printed line for separation may consist of two printed lines 26*a* and 26*b* connected to the bus bars 22 and 24, respectively, as shown in FIG. 6.

Figure 7:
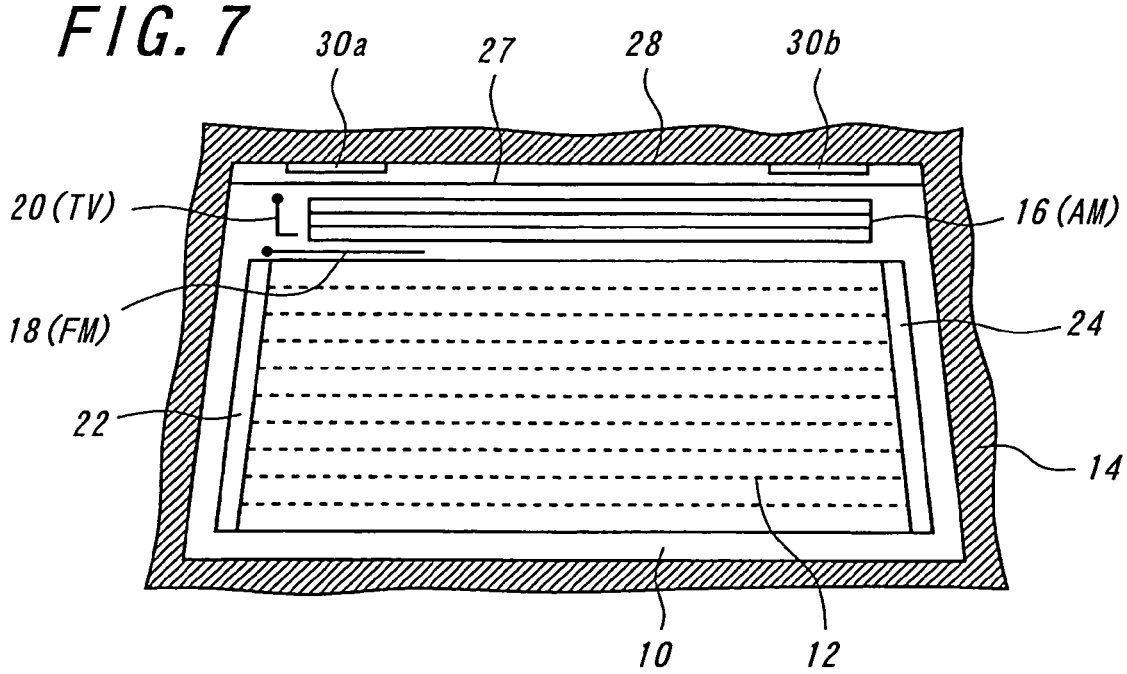
FIG. 7 shows a further example of a glass antenna for vehicles in accordance with the present invention.

The printed line for separation may be connected not to the bus bars for heating lines but to the vehicle body. In this case, the printed line for separation may consist of one printed line both ends thereof are connected to the vehicle body through lead wires, respectively. The printed line is shown by reference numeral 27 in FIG. 7.

Figure 8:
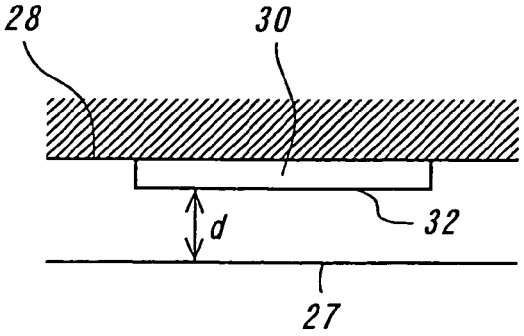
FIG. 8 shows an enlarged view of FIG. 7.

Assuming that the distance between the slot antenna 30 and the sliver printed line 27 for separation is d as shown in FIG. 8 which is a partial enlarged drawing, the sensitivities of slot antennas in d=0, 5, 10 and 20 mm are determined.

In this case, the line width of the silver printed line 27 for separation is 1 mm, the length L of the slot antenna 30 is 0.9 λ×κ, the feeding point X is L/10, and the line width of the silver printed line 32 structuring the slot antenna 30 is 1 mm.

Measured results are shown in Table 3. The frequency is varied in a range of 470–704 MHz. The case of d=0 shows that the slot antenna and the silver printed line for separation are contacted.

TABLE 3

| Frequency | d = 0 | d = 5 | d = 10 | d = 20 |
|---|---|---|---|---|
| 470 | −21.4 | −20.8 | −18.7 | −17.0 |
| 476 | −22.0 | −21.8 | −19.8 | −19.0 |
| 482 | −21.8 | −21.7 | −20.2 | −19.6 |
| 488 | −20.8 | −20.8 | −19.2 | −18.1 |
| 494 | −20.6 | −20.6 | −19.5 | −18.2 |
| 500 | −20.1 | −20.2 | −19.8 | −18.9 |
| 506 | −19.7 | −19.8 | −19.5 | −18.8 |
| 512 | −18.4 | −18.5 | −18.8 | −17.8 |
| 518 | −17.9 | −18.2 | −18.9 | −18.0 |
| 524 | −16.2 | −17.5 | −18.1 | −17.0 |
| 530 | −13.7 | −14.7 | −15.3 | −14.3 |
| 536 | −12.7 | −13.0 | −13.9 | −13.0 |
| 542 | −12.1 | −12.4 | −13.2 | −12.3 |
| 548 | −11.5 | −11.9 | −12.3 | −11.6 |
| 554 | −11.3 | −11.1 | −11.3 | −10.9 |
| 560 | −11.1 | −10.7 | −10.6 | −10.3 |
| 566 | −10.8 | −10.5 | −10.3 | −9.5 |
| 572 | −11.1 | −10.8 | −10.4 | −9.8 |
| 578 | −11.5 | −11.5 | −10.9 | −10.4 |
| 584 | −11.3 | −11.4 | −10.7 | −10.2 |
| 590 | −11.4 | −11.1 | −10.1 | −9.6 |
| 596 | −11.1 | −11.9 | −10.3 | −9.9 |
| 602 | −9.9 | −12.0 | −10.2 | −9.8 |
| 608 | −9.3 | −11.9 | −10.1 | −9.5 |
| 614 | −9.4 | −11.6 | −10.2 | −9.5 |
| 620 | −10.1 | −11.8 | −10.5 | −9.9 |
| 626 | −10.2 | −11.8 | −11.0 | −10.2 |
| 632 | −10.5 | −11.0 | −12.0 | −10.6 |
| 638 | −11.6 | −11.3 | −13.0 | −11.6 |
| 644 | −12.2 | −11.6 | −12.1 | −12.5 |
| 650 | −12.1 | −11.4 | −11.3 | −11.6 |
| 656 | −12.1 | −11.6 | −11.4 | −11.5 |
| 662 | −12.2 | −11.9 | −11.7 | −11.9 |
| 668 | −12.4 | −12.2 | −12.1 | −12.1 |
| 674 | −12.4 | −12.3 | −12.0 | −12.0 |
| 680 | −12.8 | −12.4 | −12.0 | −12.0 |
| 686 | −13.3 | −12.9 | −12.3 | −12.3 |
| 692 | −13.7 | −13.2 | −12.1 | −12.3 |
| 698 | −14.1 | −14.0 | −12.8 | −13.0 |
| 704 | −14.7 | −14.4 | −13.5 | −13.7 |
| Average sensitivity | −13.8 | −14.0 | −13.6 | −13.0 |

Figure 9:
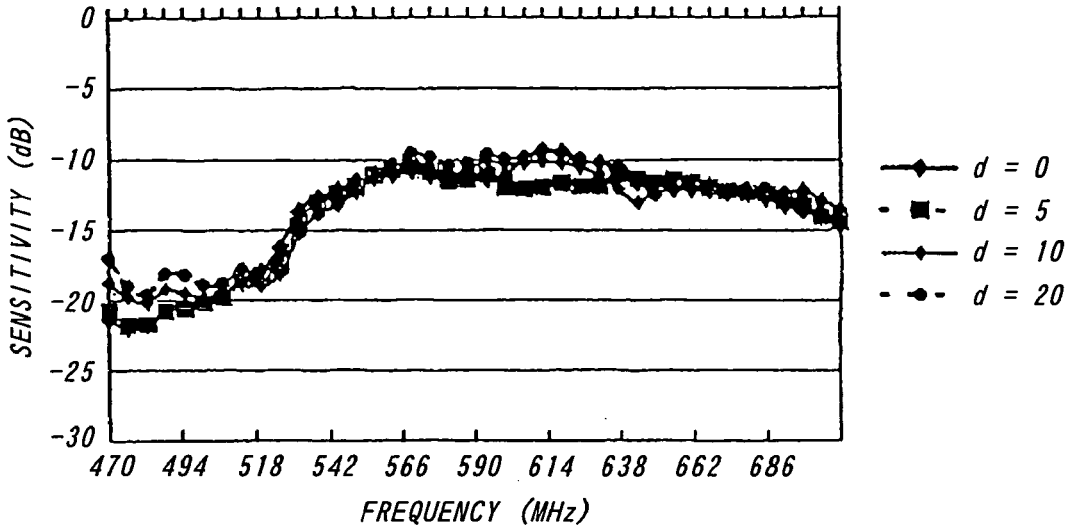
FIG. 9 shows the measured results of antenna sensitivities.

FIG. 9 shows measured results in a graph manner. It is appreciated that the sensitivity is not degraded even if the silver printed line 27 is approached to the slot antenna 30. It is also recognized that the printed line for separation serves as same as the vehicle body for the existed other antennas. Consequently, a glass antenna in accordance with the present invention may be designed without taking care of the characteristics of the slot antenna. That is, it is understood that the interference from the other antenna is less.

One of the features of the slot antenna in accordance with the present invention is that a better sensitivity may be obtained in the direction where the slot antenna is provided on the vehicle body. Therefore, where antennas are provided on a front glass and rear glass to implement a diversity switching, a reception quality having a less ghost may be realized because only desired waves are received and undesired reflected waves are not received.

Figure 10:
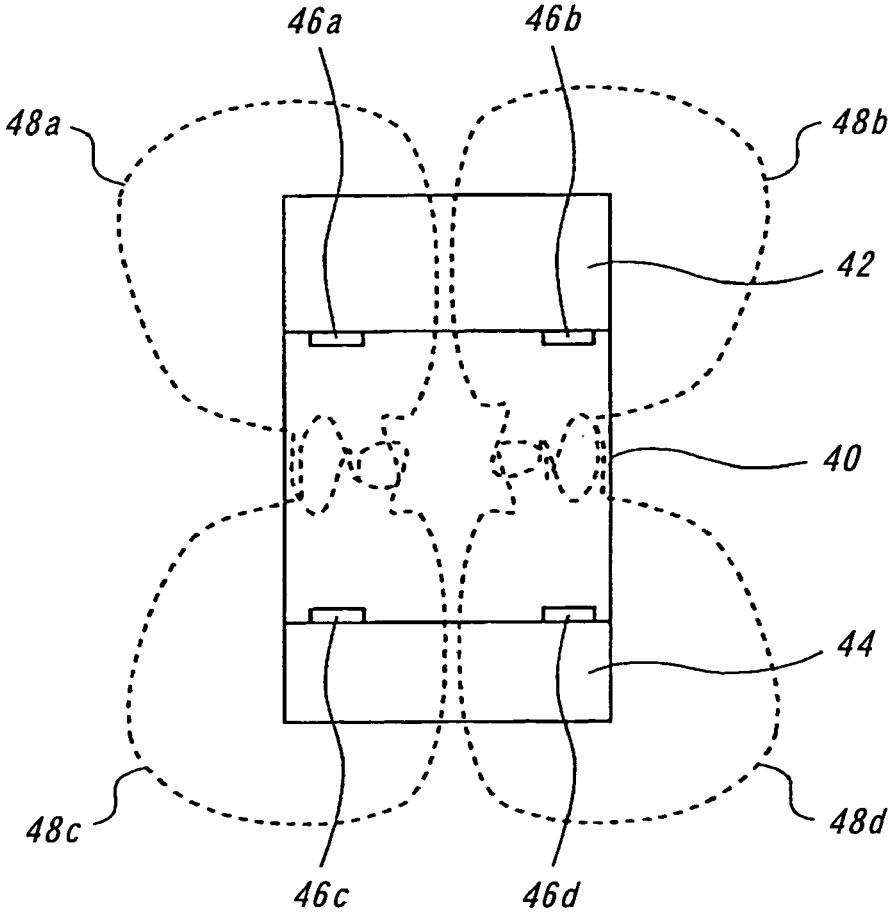
FIG. 10 shows four slot antennas constructing a diversity system.

Referring to FIG. 10, there are shown four slot antennas structuring a diversity system. Two slot antennas 46*a* and 46*b* are formed on the upper edge of a front glass 44 of a vehicle 40, and two slot antennas 46*c* and 46*d* on the upper edge of a rear glass 44 of the vehicle 40.

In this case, a printed line for separation is no needed on the front glass 42, because there are neither heating lines nor AM, FM and TV antennas formed by silver printed lines thereon. This situation is different from that in the glass antennas formed on the rear glass. FIG. 10 also shows directivities of respective slot antenna 46*a*, 46*b*, 46*c* and 46*d*. In the figure, the directivities are denoted by reference numerals 48*a*, 48*b*, 48*c* and 48*d*. A ghost may be decreased by a diversity switching in the system.

Different from a diversity separation, a desired directivity may be realized by phase synthesizing output signals from some of the four slot antennas. This antenna system is generally called as an array antenna system.

While a rectangular slot antenna is structured in the above-described embodiments in such a manner that one side thereof is formed by an edge of the vehicle body surrounding a glass window, and residual three sides are formed by one printed line both ends thereof are connected to the body by lead wires, one printed line may be formed in parallel with the edge of the body, the both ends of the one printed line being connected to the body by lead wires, respectively.

The invention claimed is:

1. A glass antenna for vehicles formed on a window glass for receiving a digital TV band comprising:

a rectangular slot antenna one side thereof is formed by an edge of a vehicle body surrounding the window glass and residual three sides thereof are formed by a printed line formed on the window glass, both ends of the printed line being connected to the vehicle body by means of lead wires, respectively; and a feeder for feeding electric power to the slot antenna.

2. A glass antenna for vehicles according to claim 1, wherein the length of the slot antenna is ½×κ–9/10×κ times the wave length of UHF band, κ being a shortening factor.

3. A glass antenna for vehicles according to claim 1, wherein the width of the slot antenna is 1/100×κ–1/25×κ times the wave length of UHF band, κ being a shortening factor.

4. A glass antenna for vehicles according to claim 1, wherein the width of the printed line is in a range of 1 mm–5 mm.

5. A glass antenna for vehicles according to claim 1, wherein the distance between a feeding terminal of the feeder and one end of the slot antenna is 1/20–¼ times the length of the slot antenna.

6. A glass antenna system for vehicles comprising:

a slot antenna recited in any one of claims 1–5 which is formed on an area between an upper edge of the vehicle body surrounding a rear glass and other at least one antenna on the rear glass on which heating lines are provided for defrosting; and a printed line for separation, formed between the slot antenna and the other at least one antenna, for reducing interference between the slot antenna and the other at least one antenna.

7. A glass antenna system for vehicles according to claim 6, wherein the printed line for separation consists of one printed line both ends thereof are connected to bus bars for the heating lines, respectively.

8. A glass antenna system for vehicles according to claim 6, wherein the printed line for separation consists of two printed lines, one end of each printed line being connected to bus bars for the heating lines, respectively.

9. A glass antenna system for vehicles according to claim 6, wherein the printed line for separation consists of one printed line both ends thereof are connected to the vehicle body by means of lead wires, respectively.

10. A glass antenna system comprising two or more slot antennas each recited in claims 1–5 for a diversity reception.

11. A glass antenna system according to claim 10, wherein two slot antennas are provided on a front glass of a vehicle and two slot antennas are provided on a rear glass of the vehicle.

* * * * *